US007464843B2

(12) United States Patent
Huang

(10) Patent No.: US 7,464,843 B2
(45) Date of Patent: Dec. 16, 2008

(54) TRIGGER SWITCH MECHANISM OF NAIL GUN

(75) Inventor: Chi-Sheng Huang, Taipei Hsien (TW)

(73) Assignee: De Poan Pneumatic Corp., Taipei (TW)

( * ) Notice: Subject to any disclaimer, the term of this patent is extended or adjusted under 35 U.S.C. 154(b) by 0 days.

(21) Appl. No.: 11/671,856

(22) Filed: Feb. 6, 2007

(65) Prior Publication Data

US 2008/0185415 A1 Aug. 7, 2008

(51) Int. Cl.
*B25C 1/04* (2006.01)

(52) U.S. Cl. ..... 227/8; 227/130; 227/156; 173/170

(58) Field of Classification Search ..... 227/8, 227/130, 142, 2, 121, 129, 170, 156; 173/170, 173/171

See application file for complete search history.

(56) References Cited

U.S. PATENT DOCUMENTS

| | | | | | |
|---|---|---|---|---|---|
| 4,264,028 | A * | 4/1981 | Austin | 227/8 |
| 5,551,621 | A * | 9/1996 | Vallee | 227/8 |
| 5,692,663 | A * | 12/1997 | Yang | 227/8 |
| 5,836,501 | A * | 11/1998 | Lai | 227/8 |
| 6,059,161 | A * | 5/2000 | Chang et al. | 227/8 |
| 6,213,372 | B1 * | 4/2001 | Chen | 227/8 |
| 6,357,647 | B1 * | 3/2002 | Ou | 227/8 |
| 6,543,664 | B2 * | 4/2003 | Wolfberg | 227/8 |
| 6,588,642 | B1 * | 7/2003 | Wang et al. | 227/8 |
| 6,659,324 | B1 * | 12/2003 | Liu | 227/8 |
| 6,675,999 | B2 * | 1/2004 | Mukoyama et al. | 227/8 |
| 6,857,547 | B1 * | 2/2005 | Lee | 227/8 |
| 6,860,416 | B1 * | 3/2005 | Chen | 227/8 |
| 6,929,165 | B1 * | 8/2005 | Chen et al. | 227/8 |
| 7,070,080 | B2 * | 7/2006 | Lin | 227/8 |
| 7,143,918 | B2 * | 12/2006 | Aguirre et al. | 227/8 |
| 7,191,927 | B2 * | 3/2007 | Segura | 227/8 |
| D560,108 | S * | 1/2008 | Butzen et al. | D8/69 |
| 7,314,154 | B2 * | 1/2008 | Huang et al. | 227/8 |
| 2006/0213947 | A1 * | 9/2006 | Bo-Seob et al. | 227/8 |

* cited by examiner

*Primary Examiner*—Paul R Durand

(57) ABSTRACT

A trigger switch mechanism of a nail gun is pivotally attached between two side plates of a trigger of the nail gun. The switch mechanism includes a blocking piece pivotally attached to a safety slide rod and a trigger valve rod of the nail gun. Each of the side plates includes an axis hole, and two blocking grooves are disposed in the axis hole. The switch mechanism includes a plurality of blocking teeth, and a spring is disposed between one of the side plate and the switch mechanism to abut the switch mechanism and nest the blocking teeth into the blocking groove for stopping the switch mechanism. The switch mechanism includes a dial portion for being dialed by a hand of the operator, which is capable of deviating the blocking teeth from the blocking grooves to release the switch mechanism, and rotating the switch mechanism to adjust the position of the blocking piece relative to the safety slide rod, so as to realize conveniently switching the operation modes of the trigger of the nail gun.

3 Claims, 11 Drawing Sheets

TRIGGER SWITCH MECHANISM OF NAIL GUN

BACKGROUND

The present invention relates to trigger switch mechanisms of pneumatic nail guns, and more particularly to a switch mechanism pivotally attached in a trigger of a nail gun, for switching the nail gun to operate in one of a sequential actuation mode and a contact actuation mode.

Pneumatic nail gun generally utilizes a compressed high pressure air in an air chamber thereof to drive a hitting rod to hit a nail, for join two objects by activating a nail through both objects, which are widely used in woodworking. The operation of the hitting rod is jointly controlled by a trigger and a safety slide rod of the nail gun.

Actuating nails of a nail gun generally can be divided into two types: sequential actuation mode and contact actuation mode.

For sequential actuation mode, before driving the nails, the operator should press a safety slide rod or a hitting base on the safety slide rod contacting on a surface of a workpiece to push a blocking piece in a trigger upwardly move, and then press the trigger to induce the blocking piece to move with the trigger, for actuating a trigger valve to set the nail gun in the status of hitting nails. If the operator wants to drive the nails again, he or she has to release the trigger firstly, and then repeat the process of pressing the trigger. If the operator disobeys the operating sequence, i.e. pressing the trigger firstly, and then pressing the safety slide rod or the hitting base, the blocking piece in the trigger cannot be induced to move with and the trigger valve cannot be actuated. That is, the nails are restrained. In other words, even if the operator wrongly touched the safety slide rod or the hitting base after the trigger is pressed, the dangerous of unexpectedly hitting the nails are avoided.

The contact actuation mode behave in another manner, before driving the nails, the operator should continuously press the trigger, and then let the safety slide rod or the hitting base to contact hit the surface of the workpiece, which induce the blocking piece to upwardly move for actuating the trigger valve in each hitting process. In addition, the contact actuation mode also allows that the operator sets the safety slide rod or the hitting base on the surface of the workpiece in advance, to induce the blocking piece to upwardly move, and then individually or continuously presses the trigger to respectively drive single or multiple nails for nailing the workpiece.

These two actuation modes have been employed in a conventional nail gun via utilizing a switch mechanism disposed in the trigger to realize switching the operation modes of one of the sequential actuation mode and the contact actuation mode. For example, U.S. Pat. No. 6,588,642 disclosed a biased adjusting rod pivotally attached in a trigger, which includes a pressing spring, a pressing plate, and a rotatable button. The biased adjusting rod can induce a top blocking piece to upwardly or downwardly move in the trigger so as to control the against portion of the top blocking piece relative to a safety plate. Then the stapler can be switched between the operation modes of the sequential actuation mode and the contact actuation mode.

When switches the operation modes, it needs the operator to press the pressing plate and the rotatable button at the same time. However, during the process of operating the nail gun, the operator has to grasp the workpiece or tools by another hand. In other words, in most working environments, such as nailing the workpiece in a high place, the operator cannot conveniently switch the switch mechanism in the trigger by both two hands. Furthermore, the biased adjusting rod is pivotally attached to a pivot plate in the trigger, which makes the structure of the trigger unduly complicated, and increases the manufacturing cost of the trigger.

Accordingly, what is needed is a trigger switch mechanism of a nail gun that can overcome the above-described deficiencies.

BRIEF SUMMARY

A trigger switch mechanism for a nail gun is capable of conveniently switching the operation modes of one of the sequential actuation mode and the contact actuation mode via touching a single point of the trigger switch mechanism by a single hand of an operator.

A trigger is pivotally attached between a safety slide rod and a trigger valve rod of a nail gun, and the trigger includes two side plates. Each of the side plates includes an axis hole, and a switch mechanism is pivotally attached between the two axis holes.

The switch mechanism includes a first pivot portion, and the switch mechanism is pivotally attached between the two axis holes via the first pivot portion. The switch mechanism further includes a second pivot portion biased relative to the first pivot portion, and the second pivot portion includes a blocking piece corresponding to the safety slide rod and the trigger valve rod.

The axis hole of at least one of the side plate includes two blocking grooves, and the first pivot portion includes at least one blocking tooth. A spring is disposed between the switch mechanism and the side plate for pressing against the switch mechanism to induce the at least one blocking tooth to engage with the blocking grooves, so as to stop the trigger mechanism.

The switch mechanism further includes a dial portion for modulating by fingers of the operator, which is capable of inducing the blocking tooth to deviate from the blocking groove for releasing the switch mechanism. The dial portion is also capable of switching a corresponding position of the blocking piece relative to the safety slide rod, to ensure that switching operation modes is convenient enough.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Figure 1:
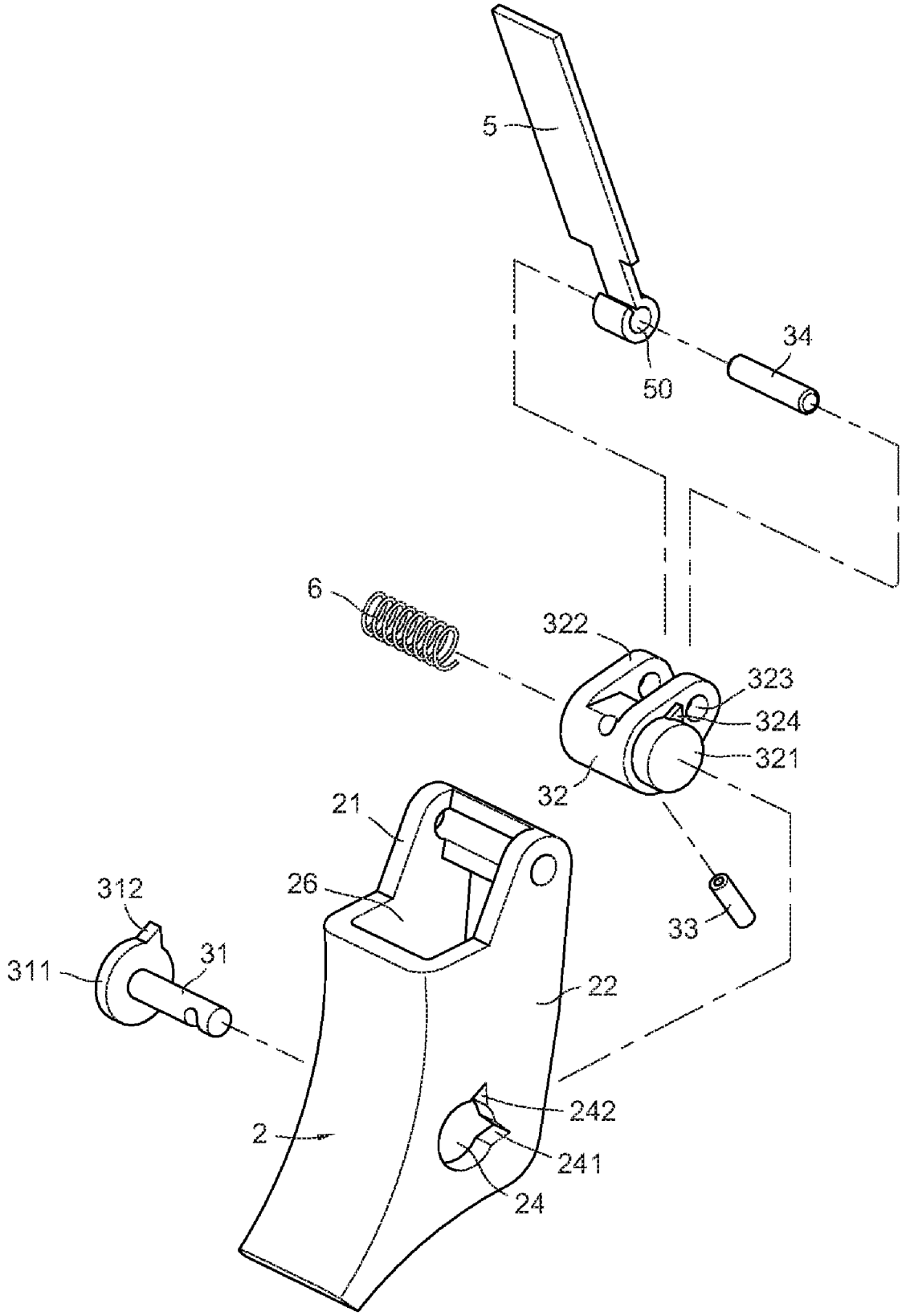
FIG. 1 is an exploded, perspective view of a trigger switch mechanism according to a first embodiment of the present invention.

Referring to FIG. 1, an exploded, perspective view of a trigger switch mechanism according to a first embodiment of the present invention is shown. Also referring to FIGS. 2, 3 and 4, a trigger 2 is pivotally attached between a safety slide rod 11 and a trigger valve rod 12 of a nail gun 1. The cross-sectional view of the trigger 2 has a U-shaped, and the trigger 2 includes two side plates 21 and 22, a receiving groove 25 formed between the two side plates 21 and 22 having an opening 26 and a notch 27. Each of the side plates 21 and 22 includes an axis hole 23 and 24 (as shown in FIGS. 5 and 5*a*), and a switch mechanism 3 is pivotally attached between the two axis holes 23 and 24.

Figure 2:
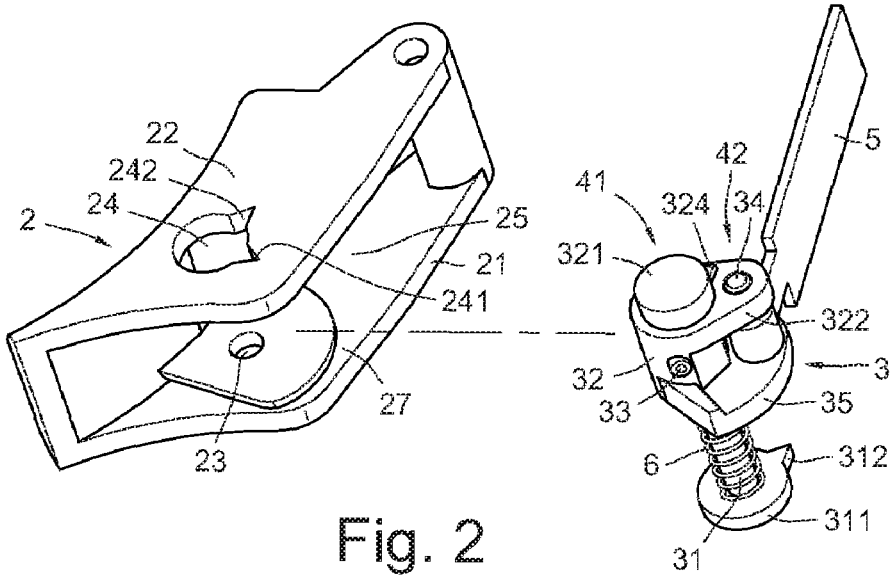
FIG. 2 is another exploded, perspective view of the trigger switch mechanism of FIG. 1.
Figure 3:
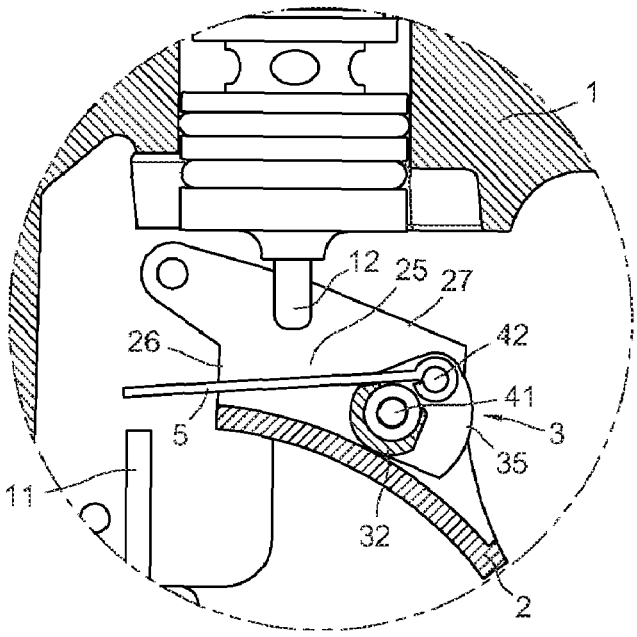
FIG. 3 is an enlarged, cross-sectional view of the trigger switch mechanism according to the first embodiment.
Figure 4:
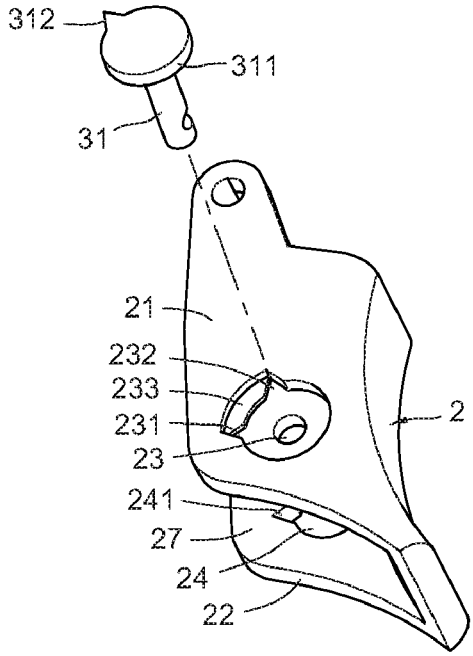
FIG. 4 is further another exploded, perspective view of the trigger switch mechanism of FIG. 1.
Figure 6:
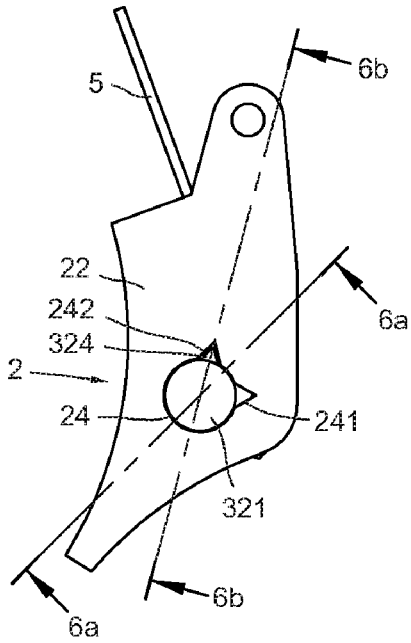
FIGS. 6, 6*a* and 6*b* are cross-sectional views of the trigger switch mechanism respectively according to the first embodiment.
Figure 6A:
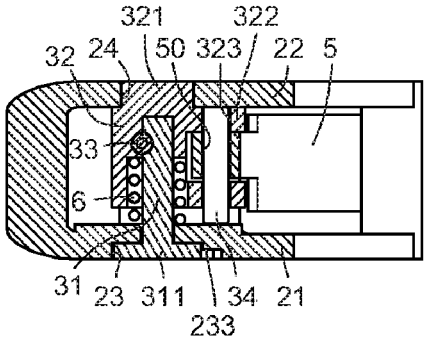
Figure 6B:
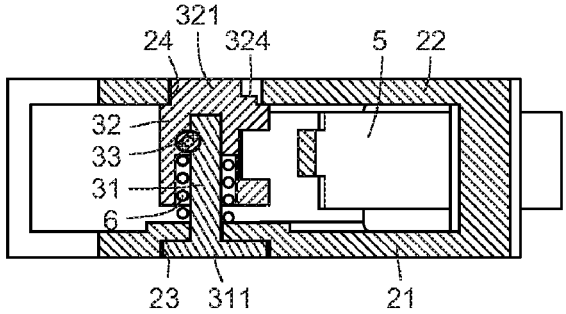

The switch mechanism 3 includes a fixing bolt 33 prong into a base portion 32 for locating an axis rod 31, and the axis rod 31 is integrated with the base portion 32 (as shown in FIGS. 6, 6*a*, and 6*b*). The base portion 32 and the axis rod 31 cooperatively form a first continuous pivot portion 41 (as shown in FIGS. 2 and 3). In detail, the first pivot portion 41 includes a first pivot axis 311 formed at one end of the axis rod 31, and a second pivot axis 321 formed at one end of the base portion 32, which are used to pivotally attach the switch mechanism between the axis holes 23 and 24. Moreover, a second pivot portion 42 is biasedly disposed relative to the first pivot portion 41, which includes a pivot base 322 with a plurality of through holes 323. The pivot base 322 is formed on the base portion 32 biased relative to the second pivot axis 321. The through holes 323 includes an axis rod 34 therein, and a pivot hole 50 for pivotally attaching a blocking piece 5. The blocking piece 5 is extended out of the opening 26 and corresponded to the safety slide rod 11.

Figure 5:
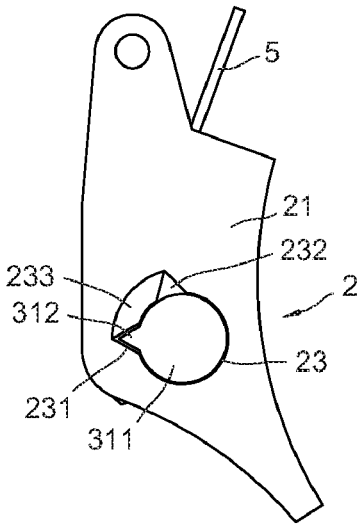
FIG. 5 is a left side view of the trigger switch mechanism of FIG. 4.
Figure 5A:
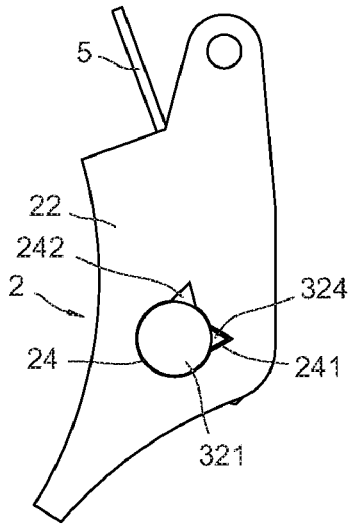
FIG. 5*a* is a right side view of the trigger switch mechanism of FIG. 4.

The axis hole 23 of the side plate 21 includes two wedged-shaped blocking grooves 231 and 232 and a guiding groove 233 (as shown in FIGS. 5 and 5*a*). The blocking grooves 231 and 232 are formed in the guiding groove 233. The axis hole 24 of the side plate 22 includes two wedged-shaped blocking grooves 241 and 242.

The first pivot portion 41 includes a plurality of blocking teeth. The blocking teeth includes a plurality of wedged-shaped first blocking teeth 312 formed at the first pivot axis 311 of the axis rod 31, and a plurality of wedged-shaped second blocking teeth 324 formed at the second pivot axis 321 of the base portion 32.

The switch mechanism 3 further includes a spring 6 nested with the axis rod 31 between the base portion 32 and the side plate 21, which is used for inducing the first blocking teeth 312 to nest into the blocking grooves 231 of the axis hole 23 (as shown in FIGS. 5 and 5*a*), and inducing the second blocking teeth 324 to nest into the blocking grooves 241 and 242 of the axis hole 24, so as to stop the switch mechanism 3.

The switch mechanism 3 includes integral element comprised of an arc-shaped dial portion 35 (as shown in FIGS. 2 and 3) formed at the base portion 32, which is capable of being dialed by fingers of the operator. The operator can release the switch mechanism 3 via dialing the dial portion 35 to induce the first and second blocking teeth 312 and 324 to deviate from the blocking grooves 231, 232, 241 and 242 respectively, so as to switch a corresponding position of the blocking piece 5 of the switch mechanism 3 relative to the safety slide rod 11.

With these configurations, the switch mechanism 3 can realize switching the operation modes of the trigger 2 of the nail gun 1. The detail operating process of switching the modes of sequential actuation mode and contact actuation mode will be described as below.

Figure 8:
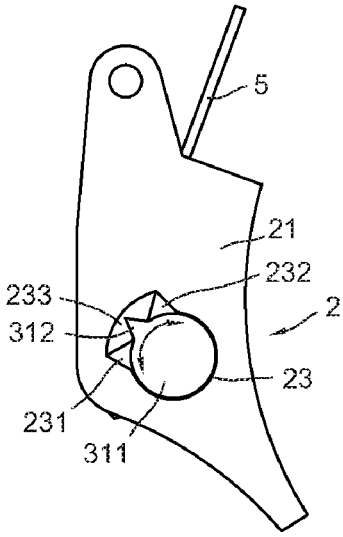
FIG. 8 is a left side view of the trigger switch mechanism according to the first embodiment, showing the operating status thereof.
Figure 8A:
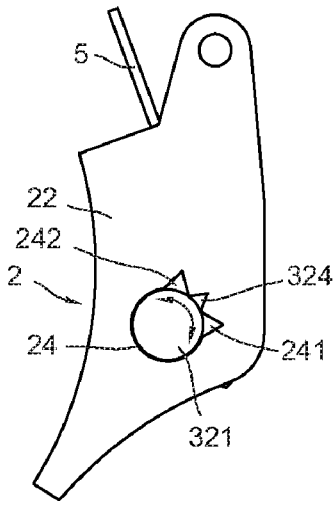
FIG. 8*a* is a right side view of the trigger switch mechanism according to the first embodiment, showing the operating status thereof.
Figure 9:
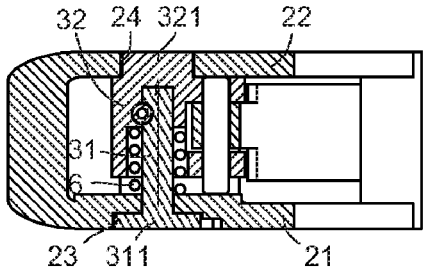
FIG. 9 is another cross-sectional view of the trigger switch mechanism according to the first embodiment, showing the operating status thereof.
Figure 10:
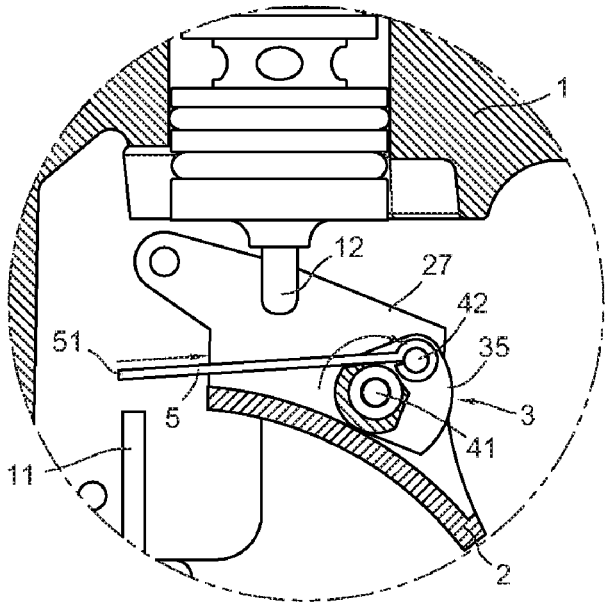
FIG. 10 is an enlarged, cross-sectional view of the trigger switch mechanism according to the first embodiment, showing the operating status thereof.

For sequential actuation mode, a finger of the hand grasping the nail gun 1 of the operator can extend into the notch 27 of the trigger 2 (as shown in FIGS. 2 and 3), to push the dial portion 35 of the switch mechanism 3 for inducing the first pivot axis 311 and the second pivot axis 321 to axially move in the axis hole 23 and 24 respectively, to induce the first and second blocking teeth 312 and 324 deviate from the blocking grooves 232 and 242 respectively. Meaning while, the operator can dial the dial portion 35 (as shown in FIGS. 8 and 8*a*) to induce the first and second blocking teeth 312 and 324 to rotate to a place upon the blocking grooves 231 and 241. During this operation process, the first blocking teeth 312 are sliding in the guiding grooves 233, to guide the switch mechanism 3 to rotate. The operator can release the dial portion 35 at this time to let the first and second pivot axes 311 and 321 to be pushed into the axis holes 23 and 24 by the spring 6 (as shown in FIG. 9). The first and second blocking teeth 312 and 324 are nested into the blocking grooves 231 and 241, respectively, so as to induce the switch mechanism 3 to bring the blocking piece 5 to move to the position of a sequential actuation mode (as shown in FIG. 10). That is, an end portion 51 of the blocking piece 5 is corresponded to the safety slide rod 11.

Figure 11:
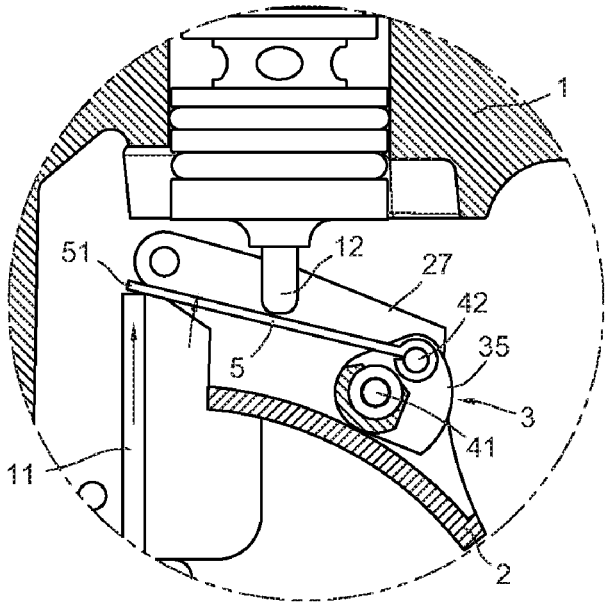
FIGS. 11 and 11*a* are enlarged, cross-sectional views of the trigger switch mechanism of FIG. 10, respectively, showing the continuously operating status thereof.
Figure 11A:
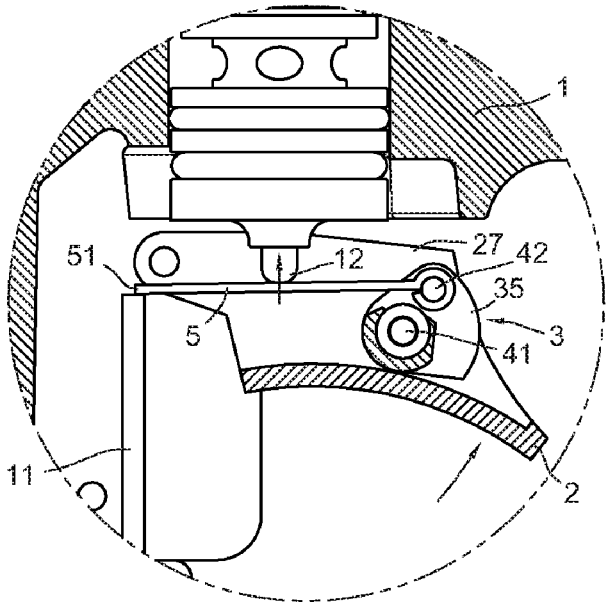

In use, the operator has to press a hitting base at a bottom portion of the safety slide rod 11 on a surface of a workpiece, to abut the safety slide rod 11 upwardly move (as shown in FIG. 11). The safety slide rod 11 will push the end portion 51 of the blocking piece 5 to induce the blocking piece 5 to upwardly move adjacent to the trigger valve rod 12. Then, the operator can press the trigger 2 (as shown in FIG. 11*a*), to bring the second pivot portion 42 of the blocking piece 5 upwardly move, for inducing the blocking piece 5 upwardly move to abut the trigger valve rod 12, so as to drive the hitting rod to individually and sequentially hit the nails.

Figure 12:
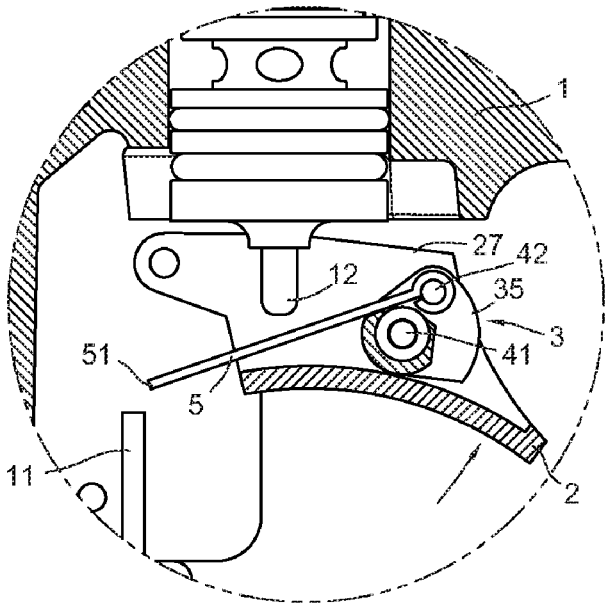
FIGS. 12 and 12*a* are enlarged, cross-sectional views of the trigger switch mechanism FIG. 10, respectively, showing another continuously operating status thereof.
Figure 12A:
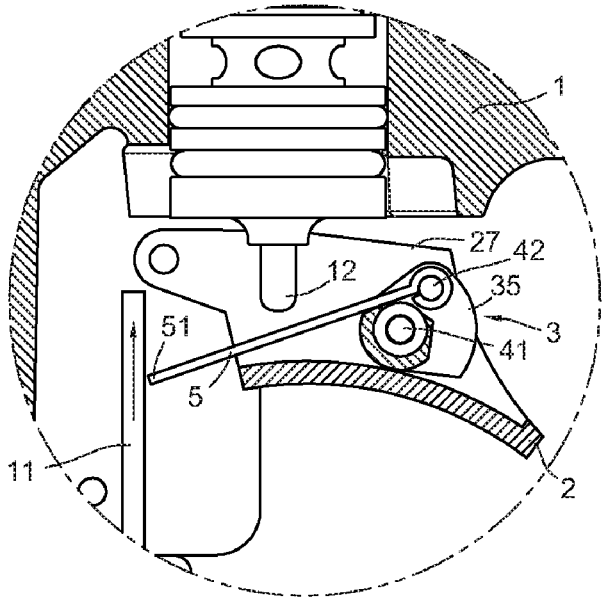

In addition, if the operator disobeys the operating sequence, i.e. accidentally pressing the trigger 2 firstly (as shown in FIG. 12), and then wrongly inducing the hitting base to bring the safety slide rod 11 to upwardly move (as shown in FIG. 12*a*), the dangerous of unexpectedly hitting the nails are avoided. Because the blocking piece 5 is actuated while the trigger 2 is pressed, and then the position of the end portion 51 of the blocking piece 5 to upwardly move has been blocked off. Therefore, the trigger valve rod 12 cannot be driven to hit nails. That is, the switch mechanism 3 ensures that the nail gun 1 with the trigger 2 can be reliably operated in the sequential actuation mode.

Figure 7:
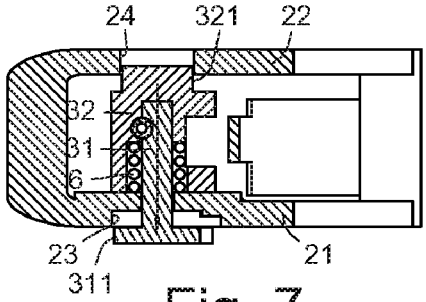
FIG. 7 is a cross-sectional view of the trigger switch mechanism according to the first embodiment, showing the operating status thereof.
Figure 13:
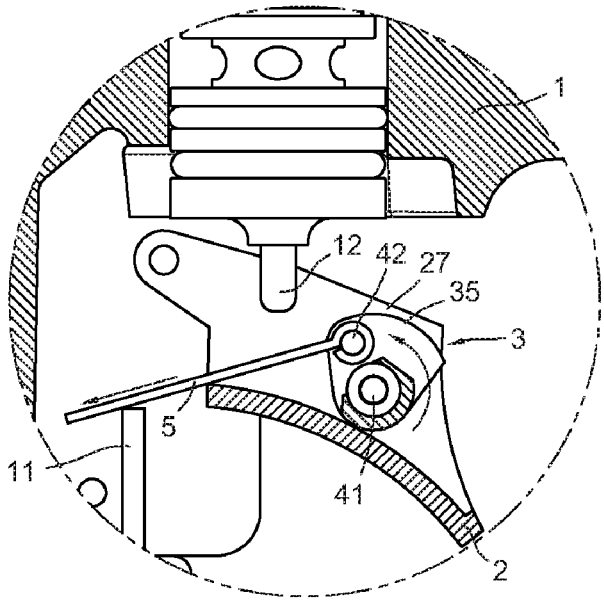
FIG. 13 is another enlarged, cross-sectional views of the trigger switch mechanism according to the first embodiment, showing the operating status thereof.

The contact actuation mode behave in another manner, the finger of the hand of the operator that grasping the nail gun 1 can extend into the notch 27 to dial the dial portion 35 (as shown in FIGS. 2 and 3), to induce the first and second blocking teeth 312 and 324 to deviate from the blocking grooves 231 and 241, respectively (as shown in FIGS. 7, 8, and 8*a*), and to induce the first and second blocking teeth 312 and 324 to nest into the blocking grooves 232 and 242, respectively (as shown in FIG. 9). After that, the blocking piece 5 is largely moved toward top portion of the safety slide rod 11, so as to adjust the switch mechanism 3 to bring the blocking piece 5 to the place of contact actuation mode (as shown in FIG. 13).

Figure 14:
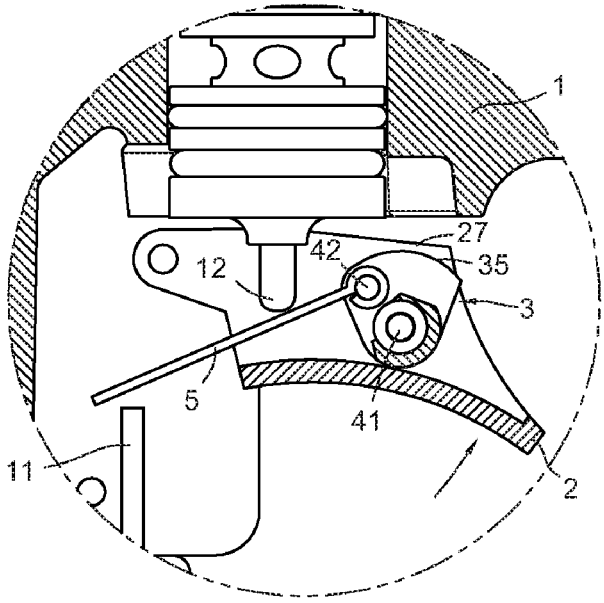
FIGS. 14 and 14*a* are enlarged, cross-sectional views of the trigger switch mechanism of FIG. 13, respectively, showing the continuously operating status thereof.
Figure 14A:
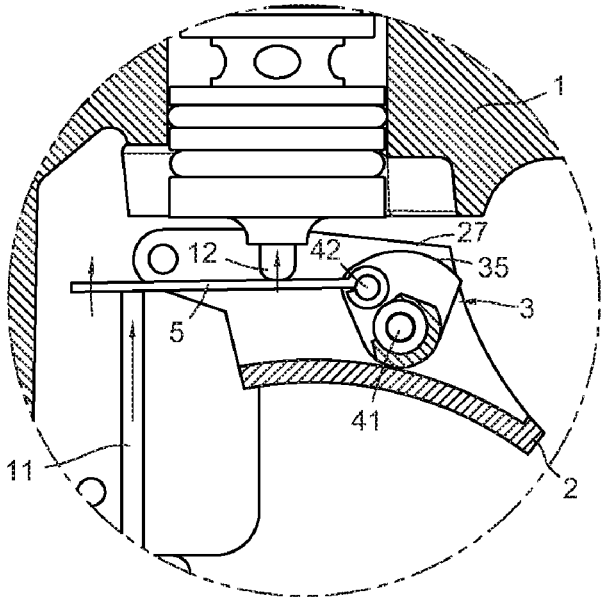

In use, the operator can press the trigger 2 to a bottom portion (as shown in FIG. 14) to induce the second pivot portion 42 of the blocking piece 5 upwardly move. At this time, the blocking piece 5 is largely moved toward top portion of the safety slide rod 11. That is, the blocking piece 5 still can correspond to the safety slide rod 11. After that, the hitting base at the bottom portion of the safety slide rod 11 is pressed on a surface of a workpiece, to abut the safety slide rod 11 upwardly move (as shown in FIG. 14*a*). The safety slide rod 11 will push the whole blocking piece 5 to upwardly move to abut adjacent to the trigger valve rod 12, for driving the hitting rod in the nail gun 1 operating in the contact acutation mode.

The operator can continuously press the trigger 2, and repeatly release and press the hitting base relative to the surface of the workpiece, so as to make the blocking piece 5 being induced by the safety slide rod 11 to move to and fro. That is, the nail gun 1 is operated in a continuously contact acutation mode.

Figure 15:
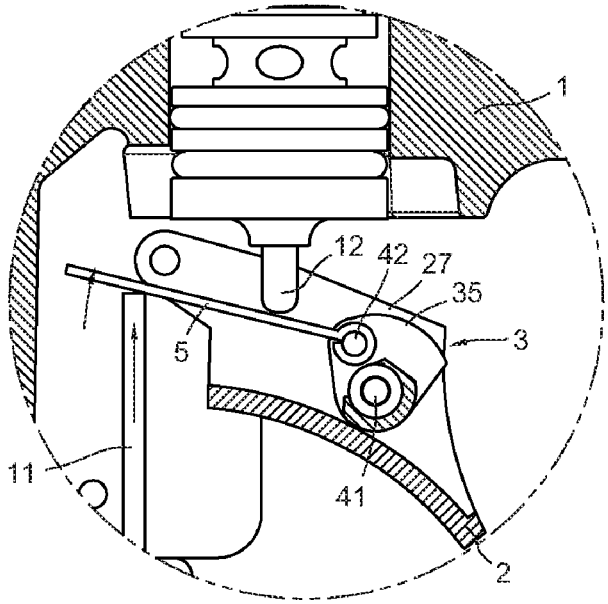
FIGS. 15 and 15*a* are enlarged, cross-sectional views of the trigger switch mechanism of FIG. 13, respectively, showing another continuously operating status thereof.
Figure 15A:
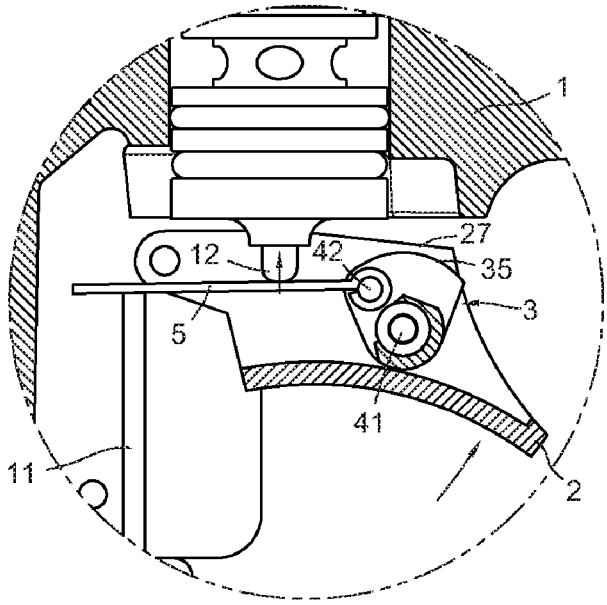

In the contact acutation mode, the operator also can press the hitting base at the surface of a workpiece firstly, so as to induce the safety slide rod 11 to move upwardly for abutting the blocking piece 5 (as shown in FIG. 15). After that, the operator can singly or continuously press the trigger 2 (as shown in FIG. 15*a*), for activating a nail or a plurality of nails into the workpiece.

The operator can conveniently switch the operation modes via dialing the dial portion 35 of the switch mechanism 3 by a single hand. In addition, the cross-sectional view of the trigger 2 has a U-shaped, which makes the structure of the trigger 2 simple, and lower the manufacturing cost thereof.

Figure 16:
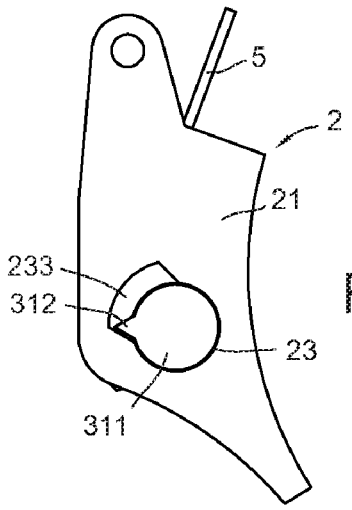
FIG. 16 is a left side view of a trigger switch mechanism according to a second embodiment of the present invention.
Figure 17:
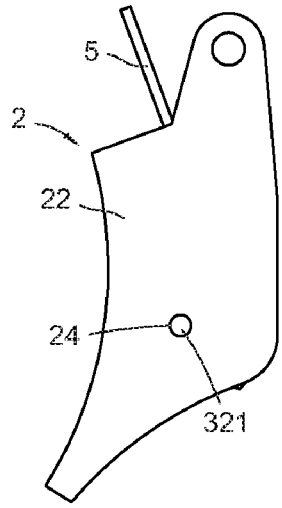
FIG. 17 is a right side view of a trigger switch mechanism according to a third embodiment of the present invention.
Figure 18:
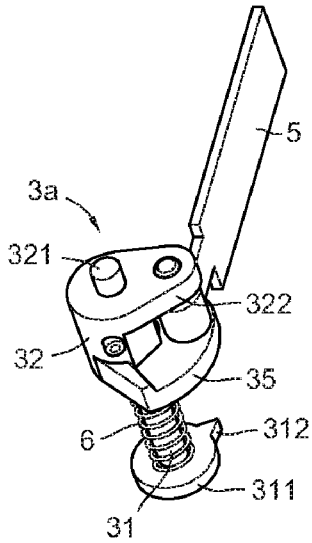
FIG. 18 is a perspective view of the trigger switch mechanism according to the third embodiment of the present invention.

Referring to FIG. 16, a perspective view of a trigger switch mechanism according to a second embodiment of the present invention is shown. The axis hole 23 of the side plate 21 includes a guiding groove 233 (as shown in FIG. 16), and the axis hole 24 of the side plate 22 includes two blocking grooves 241 and 242 (as shown in FIG. 5*a*). The first blocking teeth 312 of the switch mechanism 3 slidably disposed in the guiding groove 233, and the second blocking teeth 324 of the switch mechanism 3 nested in the blocking grooves 241 and 242. Variously, the axis hole 23 of the side plate 21 includes two blocking grooves 231 and 232, and a guiding groove 233 (as shown in FIG. 5), and the first blocking teeth 312 of the switch mechanism 3*a* slidably disposed in the guiding grooves 233 and nested into the blocking grooves 231 and 232. And the axis hole 24 of the side plate 22 has no blocking grooves (as shown in FIG. 17). Meanwhile, the second pivot axis 321 of the switch mechanism 3*a* has no blocking teeth (as shown in FIG. 18). Various and modifications of the switch mechanisms are similar to those switch mechanisms mentioned above.

The above description is given by way of example, and not limitation. Given the above disclosure, one skilled in the art could devise variations that are within the scope and spirit of the invention disclosed herein, including configurations ways of the recessed portions and materials and/or designs of the attaching structures. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A trigger switch mechanism of a nail gun, the nail gun comprising a trigger pivotally attached between a safety slide rod and a trigger valve rod of the nail gun, the trigger having two side plates, each of the side plates having a axis hole, the trigger switch mechanism being pivotally attached between the two axis holes, which comprising:

a first pivot portion, the switch mechanism being pivotally attached between the two axis holes via the first pivot portion;

a second pivot portion biased relative to the first pivot portion;

a blocking piece pivotally attached to the second pivot portion, the blocking piece corresponding to the safety slide rod and the trigger valve rod;

wherein the axis hole of one side plate comprises a guiding groove, the axis hole of another side plate comprises two blocking grooves, the first pivot portion comprises at least one first blocking tooth and at least one second blocking tooth, a spring is disposed between the side plate and the switch mechanism for abutting against the switch mechanism to induce the at least one second blocking tooth to engage with the blocking grooves, so as to stop the trigger mechanism, and wherein the blocking grooves are formed in the guiding groove; and an integral element including a dial portion and a base portion, the dial portion for modulating by fingers of the operator, which is capable of inducing the at least one second blocking tooth to deviate from the blocking grooves for releasing the switch mechanism, the dial portion is also capable of rotating the switch mechanism to induce the at least one first blocking tooth slidably disposed in the guiding groove for guiding the switch mechanism, so as to switch the blocking piece to a corresponding position relative to the safety slide rod, the base portion and an axis rod being fixed to the base portion, wherein the second pivot portion is pivotally attached to the base portion, and the first pivot portion is continuously formed by the axis rod and the base portion, the spring is nested the axis rod disposed between the base portion and the side plate.

2. The trigger switch mechanism as claimed in claim 1, wherein the two side plates form a receiving groove having an opening, and a notch between the two side plates, the blocking piece extends out of the opening and corresponds to the safety slide rod, the dial portion is disposed at the notch.

3. The trigger switch mechanism as claimed in claim 1, wherein the blocking grooves and the at least one first and second blocking teeth are wedged-shaped.

* * * * *